US006183198B1

(12) United States Patent
Manning et al.

(10) Patent No.: US 6,183,198 B1
(45) Date of Patent: Feb. 6, 2001

(54) AIRFOIL ISOLATED LEADING EDGE COOLING

(75) Inventors: Robert F. Manning, Newburyport; Paul J. Acquaviva, Wakefield; Daniel E. Demers, Ipswich, all of MA (US)

(73) Assignee: General Electric Company, Cincinnati, OH (US)

( * ) Notice: Under 35 U.S.C. 154(b), the term of this patent shall be extended for 0 days.

(21) Appl. No.: 09/192,229

(22) Filed: Nov. 16, 1998

(51) Int. Cl.[7] ..... F01D 5/18
(52) U.S. Cl. ..... 416/97 R; 416/96 R; 415/115
(58) Field of Search ..... 415/115, 116; 416/96 R, 96 A, 97 A, 97 R

(56) References Cited

U.S. PATENT DOCUMENTS 5,356,265 10/1994 Kercher .
5,387,085 2/1995 Thomas, Jr. et al. .
5,498,133 3/1996 Lee .
5,577,884 * 11/1996 Mari ..... 416/97 R
5,591,007 1/1997 Lee et al. .
5,690,473 * 11/1997 Kercher ..... 416/97 A

* cited by examiner

*Primary Examiner*—Edward K. Look
*Assistant Examiner*—Liam McDowell
(74) *Attorney, Agent, or Firm*—Andrew C. Hess; Rodney M. Young

(57) ABSTRACT

A gas turbine engine airfoil includes first and second sidewalls joined together at opposite leading and trailing edges, and spaced apart from each other therebetween to define a leading edge channel extending longitudinally from a root to a tip of the airfoil. A plurality of film cooling holes extend through the leading edge and are disposed in flow communication with the leading edge channel. An isolation plenum extends along the first sidewall and adjacent the leading edge channel, and is separated therefrom by a partition having a plurality of inlet holes. A plurality of film cooling gill holes extend through the first sidewall, and are disposed in flow communication with the isolation plenum. Cooling air is channeled from the leading edge channel to the isolation plenum for feeding the gill holes with reduced pressure air.

20 Claims, 2 Drawing Sheets

AIRFOIL ISOLATED LEADING EDGE COOLING

BACKGROUND OF THE INVENTION

The present invention relates generally to gas turbine engines, and, more specifically, to cooled turbine blades and stator vanes therein.

In a gas turbine engine, air is pressurized in a compressor and channeled to a combustor wherein it is mixed with fuel and ignited for generating hot combustion gases. The combustion gases flow downstream through one or more turbines which extract energy therefrom for powering the compressor and producing output power.

Turbine rotor blades and stationary nozzle vanes disposed downstream from the combustor have hollow airfoils supplied with a portion of compressed air bled from the compressor for cooling these components to effect useful lives thereof. Any air bled from the compressor necessarily is not used for producing power and correspondingly decreases the overall efficiency of the engine.

In order to increase the operating efficiency of a gas turbine engine, as represented by its thrust-to-weight ratio for example, higher turbine inlet gas temperature is required, which correspondingly requires enhanced blade and vane cooling.

Accordingly, the prior art is quite crowded with various configurations intended to maximize cooling effectiveness while minimizing the amount of cooling air bled from the compressor therefor. Typical cooling configurations include serpentine cooling passages for convection cooling the inside of blade and vane airfoils, which may be enhanced using various forms of turbulators. Internal impingement holes are also used for impingement cooling inner surfaces of the airfoils. And, film cooling holes extend through the airfoil sidewalls for providing film cooling of the external surfaces thereof.

Airfoil cooling design is rendered additionally more complex since the airfoils have a generally concave pressure side and an opposite, generally convex suction side extending axially between leading and trailing edges. The combustion gases flow over the pressure and suction sides with varying pressure and velocity distributions thereover. Accordingly, the heat load into the airfoil varies between its leading and trailing edges, and also varies from the radially inner root thereof to the radially outer tip thereof.

One consequence of the varying pressure distribution over the airfoil outer surfaces is the accommodation therefor for film cooling holes. A typical film cooling hole is inclined through the airfoil walls in the aft direction at a shallow angle to produce a thin boundary layer of cooling air downstream therefrom. The pressure of the film cooling air must necessarily be greater than the external pressure of the combustion gases to prevent backflow or ingestion of the hot combustion gases into the airfoil.

Fundamental to effective film cooling is the conventionally known blowing ratio which is the product of the density and velocity of the film cooling air relative to the product of the density and velocity of the combustion gases at the outlets of the film cooling holes. Excessive blowing ratios cause the discharged cooling air to separate or blow-off from the airfoil outer surface which degrades film cooling effectiveness. However, since various film cooling holes are fed from a common-pressure cooling air supply, providing a minimum blowing ratio for one row of commonly fed film cooling holes necessarily results in an excessive blowing ratio for the others.

Accordingly, it is desired to provide a turbine airfoil having improved film cooling notwithstanding external pressure variations therearound.

BRIEF SUMMARY OF THE INVENTION

A gas turbine engine airfoil includes first and second sidewalls joined together at opposite leading and trailing edges, and spaced apart from each other therebetween to define a leading edge channel extending longitudinally from a root to a tip of the airfoil. A plurality of film cooling holes extend through the leading edge and are disposed in flow communication with the leading edge channel. An isolation plenum extends along the first sidewall and adjacent the leading edge channel, and is separated therefrom by a partition having a plurality of inlet holes. A plurality of film cooling gill holes extend through the first sidewall, and are disposed in flow communication with the isolation plenum. Cooling air is channeled from the leading edge channel to the isolation plenum for feeding the gill holes with reduced pressure air.

BRIEF DESCRIPTION OF THE DRAWINGS

The invention, in accordance with preferred and exemplary embodiments, together with further objects and advantages thereof, is more particularly described in the following detailed description taken in conjunction with the accompanying drawings in which.

DETAILED DESCRIPTION OF THE INVENTION

Figure 1:
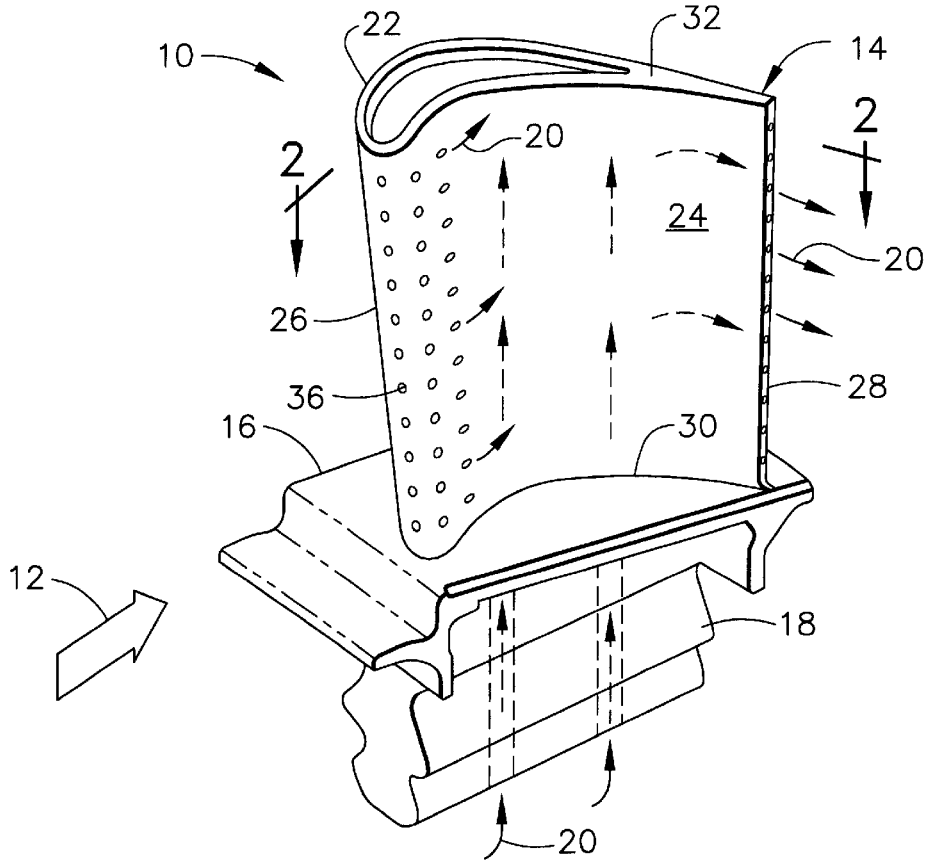
FIG. 1 is an isometric view of an exemplary gas turbine engine turbine rotor blade having an airfoil in accordance with an exemplary embodiment of the present invention.

Illustrated in FIG. 1 is a rotor blade 10 configured for attachment to the perimeter of a turbine rotor (not shown) in a gas turbine engine. The blade 10 is disposed downstream of a combustor and receives hot combustion gases 12 therefrom for extracting energy to rotate the turbine rotor for producing work.

The blade 10 includes an airfoil 14 over which the combustion gases flow, and an integral platform 16 which defines the radially inner boundary of the combustion gas flowpath. A dovetail 18 extends integrally from the bottom of the platform and is configured for axial-entry into a corresponding dovetail slot in the perimeter of the rotor disk for retention therein.

In order to cool the blade during operation, pressurized cooling air 20 is bled from a compressor (not shown) and routed radially upwardly through the dovetail 18 and into the hollow airfoil 14. The airfoil 14 is specifically configured in accordance with the present invention for improving effectiveness of the cooling air therein. Although the invention is described with respect to the airfoil for an exemplary rotor blade, it may also be applied to turbine stator vanes.

As initially shown in FIG. 1, the airfoil 14 includes a first or suction sidewall 22 and a circumferentially or laterally opposite second or pressure sidewall 24. The suction sidewall 22 is generally convex and the pressure sidewall is generally concave, and the sidewalls are joined together at axially opposite leading and trailing edges 26,28 which extend radially or longitudinally from a root 30 at the blade platform to a radially outer tip 32.

Figure 2:
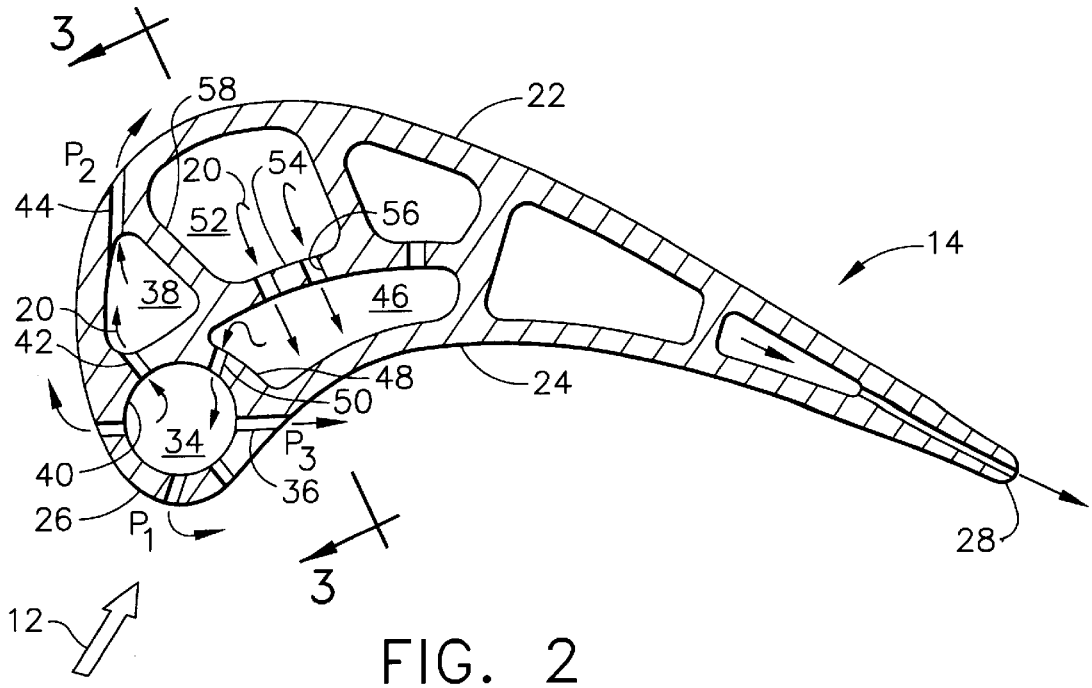
FIG. 2 is a radial sectional view through the airfoil illustrated in FIG. 1 and taken along line 2—2.

An exemplary radial section of the airfoil is illustrated in more detail in FIG. 2 and has a profile conventionally configured for extracting energy from the combustion gases 12. For example, the combustion gases 12 first impinge the airfoil 14 in the axial, downstream direction at the leading edge 26, with the combustion gases then splitting circumferentially for flow over both the suction sidewall 22 and the pressure sidewall 24 until they leave the airfoil at its trailing edge 28.

At the airfoil leading edge, the combustion gases 12 develop a maximum static pressure $P_1$, with the pressure then varying correspondingly along the suction and pressure sidewalls. Due to the convex shape of the suction sidewall 22, the combustion gases are accelerated therearound to increase velocity thereof with a corresponding reduction in pressure, with an exemplary pressure $P_2$ located downstream of the leading edge on the suction sidewall being substantially lower than the maximum pressure at the leading edge.

Similarly, the concave shape of the pressure sidewall also controls the velocity of the combustion gases as they flow downstream or aft thereover with an exemplary pressure $P_3$ being less than the maximum pressure at the leading edge and greater than the corresponding pressure $P_2$ on the opposite convex side. The pressure profile along the suction sidewall 22 is substantially less in magnitude than the pressure profile along the pressure sidewall 24 to provide an aerodynamic lifting force on the airfoil for rotating the supporting turbine rotor to produce work.

The cooling air 20 is provided to the airfoil typically at a single source pressure which is sufficiently high for driving the cooling air through various cooling circuits inside the airfoil and then being discharged through the airfoil into the turbine flowpath in which the combustion gases flow. Since the pressure and velocity profiles of the combustion gas flowing over the airfoil suction and pressure sidewalls vary, the differential pressure between the cooling air supplied inside the airfoil and the combustion gases flowing outside the airfoil correspondingly varies.

As indicated above, the blowing ratio of the cooling air discharged through holes in the airfoil may correspondingly vary and affect the cooling effectiveness of the discharged cooling air. This is most critical at the airfoil leading edge which experiences the maximum static pressure in the combustion gases with a steep gradient reduction in pressure along the suction sidewall near the leading edge, which like the leading edge itself requires effective cooling for acceptable blade life.

As initially shown in FIG. 2, the airfoil suction and pressure sidewalls are laterally spaced apart from each other between the leading and trailing edges to define several internal flow channels including a leading edge channel 34 which extends longitudinally from root to tip of the airfoil and axially aft behind the leading edge 26 for channeling the cooling air 20 therealong. A plurality of film cooling leading edge holes 36 extend through the leading edge in flow communication with the leading edge channel 34 for discharging a portion of the cooling air for film cooling the leading edge locally along the outer surface of the suction and pressure sidewalls extending therefrom.

The leading edge holes 36 may have any conventional configuration such as conical diffusion holes for increasing film coverage and effectiveness of the cooling air while reducing the amount of cooling air required. The leading edge holes are conventionally configured in several longitudinal rows spaced apart axially near the leading edge to develop corresponding films of cooling air extending downstream over both the pressure and suction sidewalls for thermally protecting the leading edge region of the airfoil from the hot combustion gases 12.

Since the static pressure of the combustion gases 12 is maximum in the region of the leading edge 26, the cooling air 20 provided in the leading edge channel 34 has a sufficiently high pressure which is suitably greater than the pressure of the combustion gases outside the leading edge channel. Suitable blowing ratios are thusly effected across the several leading edge holes 36 to maximize the effectiveness of the cooling air discharged therefrom while providing a suitable blow-off margin to prevent separation of the cooling air film from the airfoil surface.

However, as indicated above the pressure of the combustion gases 12 decreases substantially from the leading edge along the suction sidewall 22. In accordance with the present invention, cooling of this lower pressure region of the airfoil downstream of the leading edge on the suction sidewall is isolated from the cooling of the leading edge 26 itself using the leading edge channel 34 and the cooperating film cooling holes 36 fed thereby.

As shown in FIG. 2, an isolation chamber or plenum 38 is disposed along the suction sidewall 22 directly adjacent the leading edge channel 34, and is separated therefrom by an isolation or first partition 40 having a plurality of metering first inlet holes 42 for receiving a portion of the cooling air from the leading edge channel 34. The isolation plenum 38 is preferably closed except for the inlet holes 42 for receiving air from the leading edge channel 34, and except for a plurality of film cooling gill holes 44 extending through the suction sidewall 22 in a longitudinal row.

The gill holes 44 are disposed in flow communication with the isolation plenum 38 for discharging the cooling air received therefrom for film cooling the suction sidewall 22 aft of the airfoil leading edge 26. The gill holes 44 may take any conventional configuration, such as fan diffusion film cooling holes for maximizing the effectiveness of the discharged film cooling air.

The inlet holes 42 are arranged in a longitudinal row between the leading edge channel 34 and the isolation plenum 38 and are sized to restrict or meter the cooling air therebetween for reducing the pressure of the cooling air supplied to the isolation plenum. In this way, low pressure cooling air is isolated from the higher pressure air in the leading edge channel 34 to improve the blowing ratio across the gill holes 44. Since the pressure of the combustion gases outside the gill holes 44 is substantially less than the maximum pressure of the combustion gases at the leading edge 26, the pressure of the cooling air inside the isolation chamber 38 is preferably lower than the pressure of the air in the leading edge channel 34 to independently control the respective blowing ratios across the leading edge holes 36 and the gill holes 44.

As shown in FIG. 2, the inlet holes 42 preferably extend through the inlet partition 40 obliquely to the inner surface of the suction sidewall 22 for directing the cooling air in corresponding jets in impingement thereagainst for enhancing cooling effectiveness thereof as well as enhancing cooling effectiveness of the gill holes 44. The significant restriction of the inlet holes 42 reduces the coolant pressure as it impinges on the inner surface of the suction sidewall. Impingement convection cooling is maximized by the reduction in pressure, while film cooling effectiveness of the gill holes 44 is also improved due to a reduced coolant momentum to combustion gas momentum ratio. The lower momentum ratio across the gill holes 44 reduces the chance of film blow-off at this location as represented by an increase in the blowoff-margin.

The gill holes 44 are preferably disposed aft of the inlet holes 42 farther away from the leading edge 26. In this way, the leading edge channel 34 and its cooperating rows of film cooling holes 36 provides effective film cooling of the leading edge region of the airfoil in the vicinity of the maximum pressure combustion gases thereat.

The suction sidewall 22 is preferably imperforate along the isolation plenum 38 from the last row of leading edge holes 36 to the gill holes 44. The suction sidewall in this region is effectively cooled internally from the isolation plenum 38 by impingement cooling from the inlet holes 42 and convection cooling within the plenum. The spent cooling air is then discharged through the gill holes 44 into the lower pressure combustion gases thereat to form a film of cooling air therefrom for film cooling the suction sidewall 22 downstream therefrom.

In this way, airfoil cooling at the leading edge 26 is isolated from cooling downstream therefrom along the suction sidewall 22 experiencing the greatest gradient in pressure of the combustion gases 12. The blowing ratio across the leading edge holes 36 and suction side gill holes 44 may thusly be tailored to their respective locations subject to the difference in pressure of the combustion gases thereat for maximizing cooling effectiveness at both locations with corresponding blow-off margins.

Cooling effectiveness may be further enhanced by providing a midchord channel 46 disposed directly aft or behind the leading edge channel 34, and separated therefrom by a second partition 48. As additionally shown in FIG. 3, the mid-chord channel 46 and the leading edge channel 34 both extend radially or longitudinally from the root to tip of the airfoil.

The second partition includes a plurality of second inlet holes 50 for channeling the cooling air therethrough into the leading edge channel 34. The inlet holes 50 are preferably sized for metering the cooling air therethrough and effecting jets of cooling air directed across the leading edge channel 34 for impingement cooling the inner surface of the airfoil at the leading edge 26. In this way, the cooling air experiences a significant pressure drop across the inlet holes 50, and yet again experiences another significant pressure drop across the first inlet holes 42 to provide effectively lower pressure cooling air to the isolation plenum for optimizing the blowing ratio across the gill holes 44.

Figure 3:
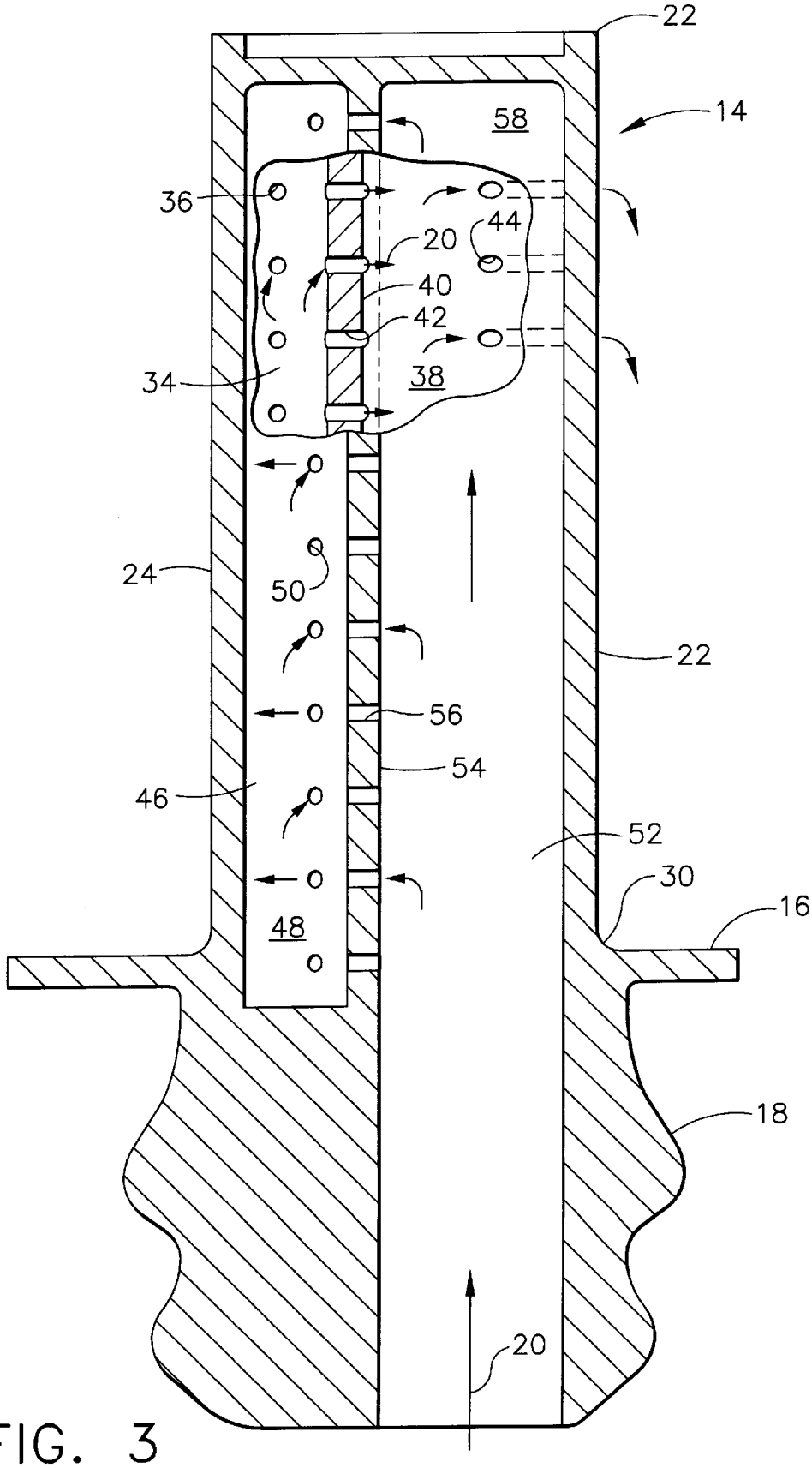
FIG. 3 is an elevational sectional view through the airfoil illustrated in FIG. 2 and taken along line 3—3.

As shown in FIGS. 2 and 3, the airfoil preferably also includes an inlet channel 52 extending longitudinally and parallel with the midchord channel 46, and separated therefrom by a third partition 54 having a plurality of third inlet holes 56 arranged in two exemplary rows for channeling the cooling air therethrough.

The midchord channel 46 preferably directly adjoins the pressure sidewall 24 aft of the leading edge channel 34, and the inlet channel 52 preferably adjoins the suction sidewall 22 directly aft of the isolation plenum 38 and separated therefrom by an imperforate fourth partition 58. The fourth partition 58 thus further isolates the isolation plenum 38 from the high pressure cooling air initially introduced through the inlet channel 52.

The cooling air preferably does not directly enter the isolation plenum 38 from the inlet channel 52 since the desired pressure reduction therebetween cannot be maximized. Instead, the cooling air 20 must flow in turn from the inlet channel 52 to the midchord channel 46, to the leading edge channel 34, and lastly to the isolation plenum 38 which is thusly separated from the inlet channel by the three sets of inlet holes 42,50,56.

As shown in FIG. 2, the airfoil 14 may also include additional cooling channels disposed aft of the midchord channel 46 and the inlet channel 52 for cooling the aft and trailing edge portions thereof in any conventional manner.

In the preferred embodiment illustrated in FIGS. 2 and 3, the leading edge channel 34 is a chamber or plenum closed at its radially inner end which receives the cooling air solely through the second inlet holes 50. Similarly, the midchord channel 46 is also a chamber or plenum closed at its radially inner end and receives the cooling air solely through the third inlet holes 56. The second and third inlet holes 50,56 to both the leading edge channel 34 and the midchord channel 46 are preferably sized to meter or restrict the cooling air therethrough, and in turn reduce pressure thereof from the inlet channel 52 to the midchord channel 46, and further in turn through the first inlets 42 to the isolation plenum 38.

In this way, the cooling air 20 initially received in the airfoil with maximum pressure flows radially upwardly through the inlet channel 52 and is firstly metered through the inlet holes 56 for impingement cooling the inner surface of the pressure sidewall 24 in the midchord channel 46. The cooling air is then metered through the inlet holes 50 for impingement cooling the inner surface of the airfoil at the leading edge 26 with a portion of the air being discharged from the leading edge channel through the several film cooling holes 36. The remaining portion of the cooling air is lastly metered through the inlet holes 42 for impingement cooling the inner surface of the suction sidewall 22 in the isolation plenum 38 and is finally discharged through the film cooling gill holes 44 at a substantially reduced pressure than when first received in the inlet channel 52.

Accordingly, the pressure of the cooling air 20 is reduced in multiple steps from the inlet channel 52 to its final discharge from the gill holes 44 for substantially improving the blowing ratio across the gill holes 44, and thus improving film cooling therefrom.

Furthermore, the same cooling air is used in multiple steps for cooling different portions of the airfoil prior to being discharged from the gill holes 44, and thusly further increases the efficiency of cooling.

This impingement in series effectively uses the cooling air multiple times before expelling the coolant through either the leading edge or gill film cooling holes 36,44. This reduces the need for cooling airflow and optimizes the cooling design by increasing cooling efficiency. The temperature of the cooling air increases as the series cooling is effected for maximizing the heat removal capability thereof.

The isolation plenum enhances film cooling effectiveness downstream from the leading edge on the airfoil suction sidewall under the substantial gradient in pressure of the combustion gases therealong. The multiple-use cooling air, including the series impingement cooling effected by the impingement holes 56,50,42 in that order, more effectively utilizes the cooling potential of the cooling air prior to being discharged from the airfoil.

While there have been described herein what are considered to be preferred and exemplary embodiments of the present invention, other modifications of the invention shall be apparent to those skilled in the art from the teachings herein, and it is, therefore, desired to be secured in the appended claims all such modifications as fall within the true spirit and scope of the invention.

Accordingly, what is desired to be secured by Letters Patent of the United States is the invention as defined and differentiated in the following claims in which we claim:

1. A gas turbine engine airfoil comprising:

first and second sidewalls joined together at opposite leading and trailing edges, and spaced apart from each other therebetween to define a leading edge channel extending longitudinally between a root and a tip of said airfoil, and disposed behind said leading edge for channeling cooling air therealong;

a plurality of film cooling leading edge holes extending through said leading edge, and disposed in flow communication with said leading edge channel for discharging a portion of said cooling air for film cooling said leading edge;

an isolation plenum disposed along said first sidewall adjacent said leading edge channel, and separated therefrom by an isolation partition having a plurality of inlet holes for receiving a portion of said cooling air from said leading edge channel and effecting lower air pressure in said isolation plenum than in said leading edge channel; and a plurality of film cooling gill holes extending through said first sidewall, and disposed in flow communication with said isolation plenum for discharging said cooling air therefrom for film cooling said first sidewall.

2. An airfoil according to claim 1 wherein said inlet holes are sized to meter said cooling air between said leading edge channel and said isolation plenum for reducing pressure therebetween.

3. An airfoil according to claim 2 wherein said inlet holes extend through said partition obliquely with said first sidewall for directing said cooling air in impingement thereagainst.

4. An airfoil according to claim 3 wherein said first sidewall is a convex, suction sidewall, and said second sidewall is a concave, pressure sidewall.

5. An airfoil according to claim 4 wherein said gill holes are disposed aft of said inlet holes.

6. An airfoil according to claim 4 further comprising a midchord channel disposed aft of said leading edge channel, and separated therefrom by a partition having a plurality of inlet holes for channeling said cooling air therethrough.

7. An airfoil according to claim 6 further comprising an inlet channel extending longitudinally and parallel with said midchord channel, and separated therefrom by a partition having a plurality of inlet holes for channeling said cooling air therethrough.

8. An airfoil according to claim 7 wherein said midchord channel adjoins said second sidewall aft of said leading edge channel, and said inlet channel adjoins said first sidewall aft of said isolation plenum.

9. An airfoil according to claim 8 wherein said inlet holes to both said leading edge channel and midchord channel are sized to meter said cooling air therethrough and reduce pressure thereof from said inlet channel to said midchord channel, and in turn through said inlets to said isolation plenum.

10. An airfoil according to claim 8 further comprising an imperforate partition disposed between said isolation plenum and said inlet channel.

11. A gas turbine engine airfoil comprising:

first and second sidewalls joined together at opposite leading and trailing edges;

a closed leading edge channel disposed behind said leading edge in flow communication with a row of film cooling leading edge holes extending therethrough;

a closed isolation plenum adjoining said leading edge channel along said first sidewall, and disposed in flow communication with a row of film cooling gill holes extending through said first sidewall; and means for channeling cooling air in turn from said leading edge channel to said isolation plenum for reducing pressure thereof and providing lower air pressure in said isolation plenum than in said leading edge channel to independently control respective blowing ratios across said leading edge holes and said gill holes.

12. An airfoil according to claim 11 wherein said air channeling means comprise a row of inlet holes disposed between said leading edge channel and said isolation plenum for metering said cooling air therebetween.

13. An airfoil according to claim 12 wherein said gill holes are disposed aft of said inlet holes.

14. An airfoil according to claim 13 wherein said first sidewall is imperforate along said isolation plenum, and said gill holes extend aft therefrom.

15. An airfoil according to claim 14 wherein said inlet holes are disposed obliquely with said first sidewall for directing said cooling air in impingement thereagainst.

16. An airfoil according to claim 12 further comprising a midchord channel disposed along said second sidewall aft of said leading edge channel in flow communication therewith for channeling said cooling air thereto.

17. An airfoil according to claim 16 further comprising an inlet channel disposed along said first sidewall in flow communication with said midchord channel, and adjoining said isolation plenum.

18. A gas turbine engine airfoil comprising:

first and second sidewalls joined together at opposite leading and trailing edges;

a leading edge channel disposed behind said leading edge in flow communication with a row of film cooling leading edge holes extending therethrough;

an isolation plenum adjoining said leading edge channel along said first sidewall, and disposed in flow communication with a row of film cooling gill holes extending through said first sidewall;

a midchord channel adjoining said leading edge channel along said second sidewall;

an inlet channel adjoining said isolation plenum along said first sidewall; and means for channeling cooling air in turn from said inlet channel to said midchord channel to said leading edge channel and to said isolation plenum.

19. An airfoil according to claim 18 wherein said air channeling means are effective for metering said air in turn from said inlet channel to said isolation plenum for providing lower air pressure in said isolation plenum than in said leading edge channel.

20. An airfoil according to claim 19 wherein said first sidewall is a convex, suction sidewall, and said second sidewall is a concave, pressure sidewall.

* * * * *